US005949007A

United States Patent [19]

Rumore

[11] Patent Number: 5,949,007

[45] Date of Patent: Sep. 7, 1999

[54] THUMB TRANSFER DEVICE FOR A WOODWIND MUSICAL INSTRUMENT

[76] Inventor: Dick J. Rumore, 2119 W. Hillsborough Ave., Tampa, Fla. 33603

[21] Appl. No.: 08/955,776

[22] Filed: Oct. 22, 1997

[51] Int. Cl.[6] ..... G10D 7/00

[52] U.S. Cl. ..... 84/380 R; 84/385 R

[58] Field of Search ..... 84/380 R, 385 R

[56] References Cited

U.S. PATENT DOCUMENTS 2,933,968 4/1960 Hearne, Jr. .

3,988,958 11/1976 Brunkow ..... 84/380 R X 4,348,935 9/1982 Bay ..... 84/380 R

*Primary Examiner*—Jeffrey W. Donels

[57] ABSTRACT

Ready movement of a thumb between positional placement locations on a woodwind musical instrument is provided by incorporating a roller within a thumb transfer device. The thumb transfer device comprises a thumb position combination having a thumb rest, a thumb key and a roller situated between the thumb rest and the thumb key. The thumb enjoys a rolling contact with the roller during the transfer. Height adjustment means allow the musician to adjusted the relative height of the various components to ensure a comfortable orientation during play.

19 Claims, 4 Drawing Sheets

THUMB TRANSFER DEVICE FOR A WOODWIND MUSICAL INSTRUMENT

BACKGROUND

1. Field of the Invention

Generally, the invention relates to finger transfer assistance devices for a key of a musical instrument. More specifically, the invention relates to such assistance devices for woodwind musical instruments wherein the assistance device has a roller and where the finger is a thumb.

2. Description of the Prior Art

Rollers on adjacent sets of keys are known for various woodwinds and other musical instruments to provide for a ready transfer of a respective finger between such keys. Typically, octave keys are positioned adjacent a fixed thumb rest. Musician occasionally utilize this thumb rest to at least partially support the woodwind musical instrument during periods of play. Additionally, when the octave key is depressed it is normally at a lower elevational level than that of the thumb rest making return transfer difficult. These factors occasionally makes transfer of the thumb between the thumb rest and the thumb octave key awkward. On those occasions the performance of the musician may suffer. Therefore, it may be appreciated that there continues to be a need for a transfer device which may assist the musician during transfer of the thumb from the thumb rest to the thumb octave key and from the thumb octave key to the thumb rest. The present invention substantially fulfills these needs.

SUMMARY

In view of the foregoing disadvantages inherent in the conventional thumb rest and thumb octave key configurations, the applicant has devised a thumb transfer device which positions a roller between a thumb contact surface of a thumb rest and a thumb contact surface of a thumb key. The roller provides for a ready movement of a thumb between the opposing placement positions during at least a portion of a transfer between the placement positions.

The invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for a thumb to have a rolling contact with a roller during at least a portion of a transfer of the thumb between a thumb rest and a thumb octave key.

Other objects include;

a) to provide for an efficient transfer of the thumb between the thumb rest and the thumb octave key.

b) to provide for a comfortable transfer of the thumb between the thumb rest and the thumb octave key.

c) to provide for adjustment of the elevational height of a thumb contact surface of the thumb rest relative to a thumb contact surface of the thumb octave key.

d) to provide for adjustment of the elevational height of a roller assembly relative to both the thumb contact surfaces of the thumb rest and the thumb octave key.

e) to provide for a retro-fit installation of a thumb transfer device having a roller on an existing woodwind musical instrument.

f) to provide for a reduction of stress to the thumb during play of the woodwind musical instrument.

g) to provide for a reduction of stress to the wrist during play of the woodwind musical instrument.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION

Figure 1:
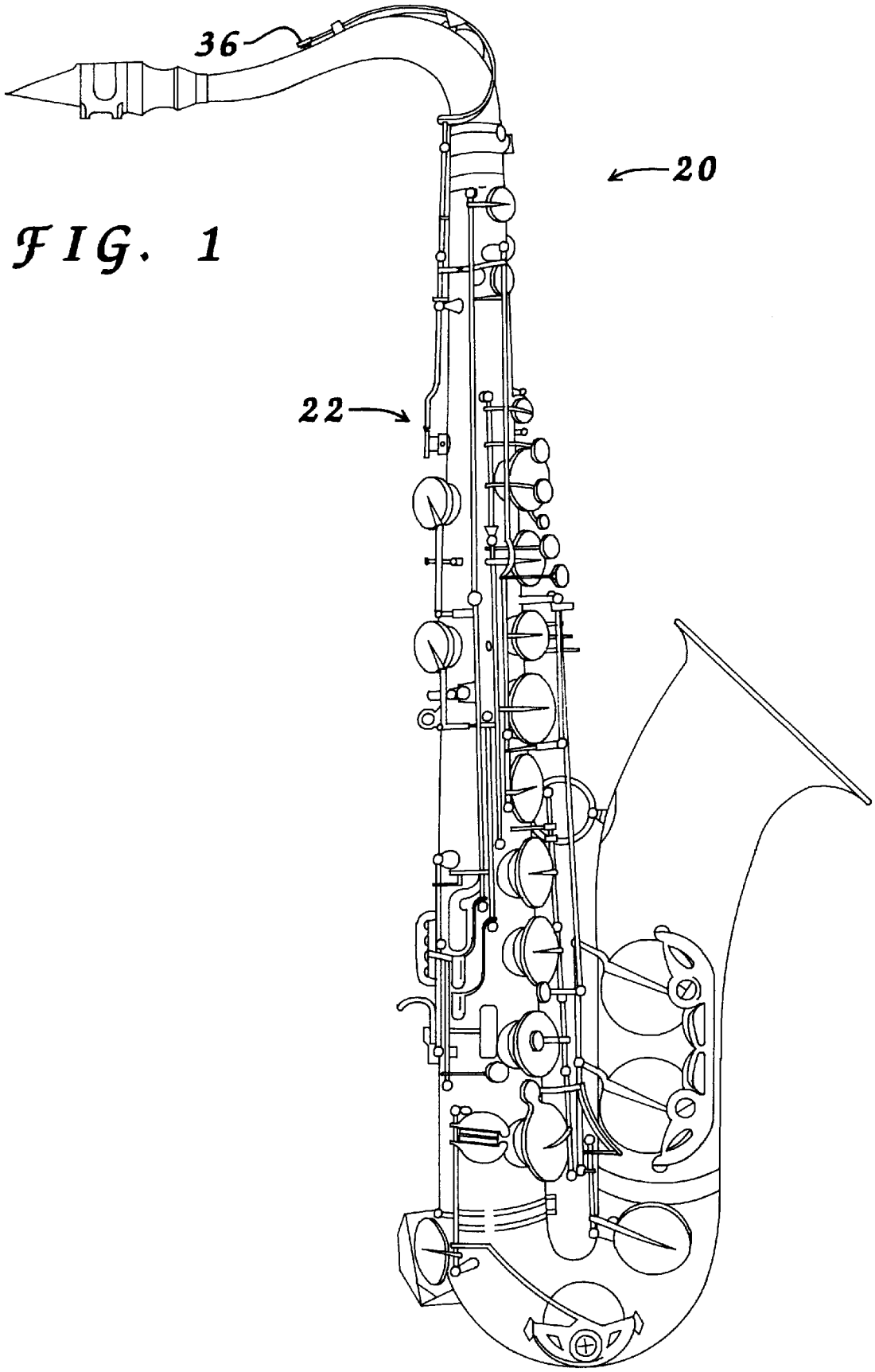
FIG. 1 is a side elevational view of a woodwind musical instrument.
Figure 2A:
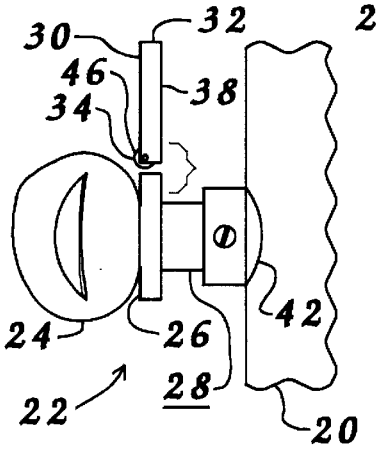
FIG. 2*a* through FIG. 2*c* are sectional side views of a thumb transfer device and a thumb in various positional orientations.

Reference is now made to the drawings where like reference numerals refer to like parts throughout the various views. A woodwind 20 is depicted having a thumb position combination 22 attached thereto. Thumb position combination 22 provides for ready movement of a thumb 24 between a thumb contact surface 26 of a thumb rest 28 and a thumb contact surface 30 of a thumb key 32, see FIG. 2*a* through FIG. 2*c*. A roller 34 positioned on thumb position combination 22 provides for a rolling contact during transfer of thumb 24 between thumb contact surface 26 and thumb contact surface 30. Thumb key 32 controls at least one, (1), octave key 36 as conventionally known in the art. Thumb key 32 has a static position 38, shown in FIG. 2*a* and FIG. 2*b*, and an active position 40, shown in FIG. 2*c*. It is conventionally known in the art to provide rollers on select key groups for woodwinds and any of the attachment means may be employed to attach roller 34 within thumb position combination 22.

Thumb rest 28 preferably is securely attached to a coupling plate 42 by any of the methods conventionally known in the art. Coupling plate 42 is similarly securely attached to woodwind 20 at a location adjacent thumb key 32. Alternatively, thumb rest 28 may be directly attached to woodwind 20 without usage of coupling plate 42.

FIG. 2*a* through FIG. 4*b* depict the preferred placement of roller 34 within thumb position combination 22. Roller 34 is rotatably secured along a terminal end 44 of thumb key 32 adjacent, and parallel to, thumb rest 28, best shown in FIG. 3. Roller 34 has a surface 46 which contacts thumb 24 during transfer thereover. Preferably, surface 46 of roller 34 extends above thumb contact surface 30.

When the musician, depicted by thumb 24, desires to leave thumb key 32 in static position 38, the musician may position thumb 24 on thumb contact surface 26 of thumb rest 28. While a fixed elevational height of thumb contact surface 26 of thumb rest 28 relative to thumb contact surface 30 of thumb key 32 is acceptable for many musicians, it is desirable to provide the musician with adjustment means to adjust such elevational height.

Figure 4A:
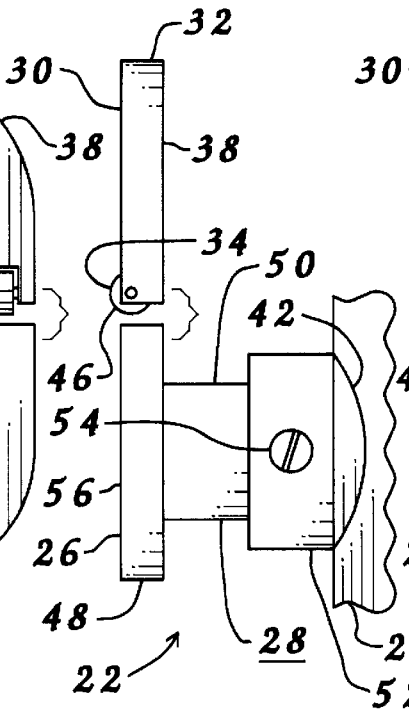
FIG. 4*a* is a side elevational view of the thumb transfer device depicted in FIG. 3.
Figure 4B:
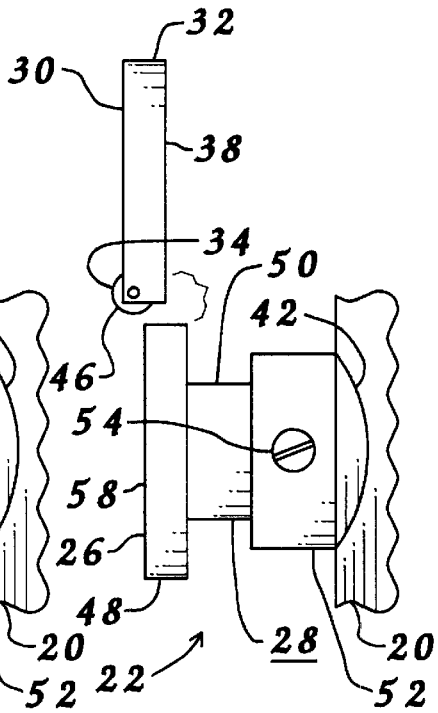
FIG. 4*b* is a side elevational view of the thumb transfer device depicted in FIG. 4*a* with an alternative elevational adjustment of a thumb rest.

Preferably, such adjustment means resides in an elevational adjustment of thumb contact surface 26 of thumb rest 28. FIG. 4*a* and FIG. 4*b* depict an elevational adjustment of thumb contact surface 26 of thumb rest 28 relative to thumb contact surface 30 of thumb key 32. Thumb rest 28 comprises a support plate 48, having thumb contact surface 26 thereon, an extension post 50, an adjustment base 52, and coupling plate 42. Adjustment base 52 has exposed thereon an adjustment screw 54 which controls devices, not shown, contained within thumb rest 28 which provide for extension and retraction of extension post 50 relative to adjustment base 52, such devices being conventionally known in the art. Adjustment screw 54 provides for passive retention of extension post 50 at any available select elevational height relative to adjustment base 52. Therefore, manipulation of adjustment screw 54 provides for elevational positioning of thumb contact surface 26 of thumb rest 28 at a desired elevational height relative to thumb contact surface 30 of thumb key 32 while thumb key 32 is in static position 38.

FIG. 4*a* depicts thumb contact surface 26 in a first elevational position 56 while thumb key 32 is in static position 38. FIG. 4*b* depicts thumb contact surface 26 in a second elevational position 58 while thumb key 32 is in static position 38. Thumb contact surface 26 of thumb rest 28 is relatively level with thumb contact surface 30 of thumb key 32 while in first elevational position 56. Thumb contact surface 26 of thumb rest 28 is at an elevational height below thumb contact surface 30 of thumb key 32 while in second elevational position 58. Any select orientation of thumb contact surface 26 and thumb contact surface 30 may be selected from a predetermined range of positions. If desired, these positions may include thumb contact surface 26 being elevated above thumb contact surface 30.

Figure 2B:
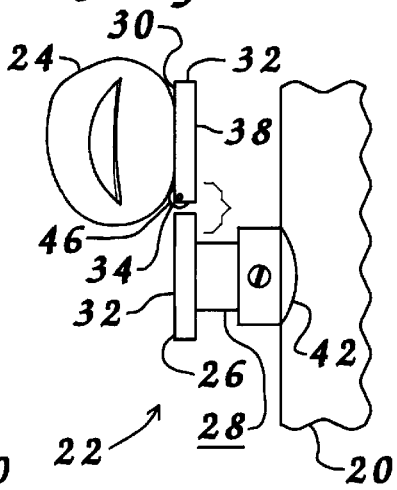
Figure 2C:
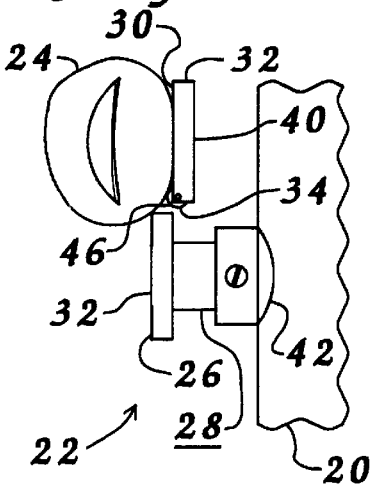
Figure 3:
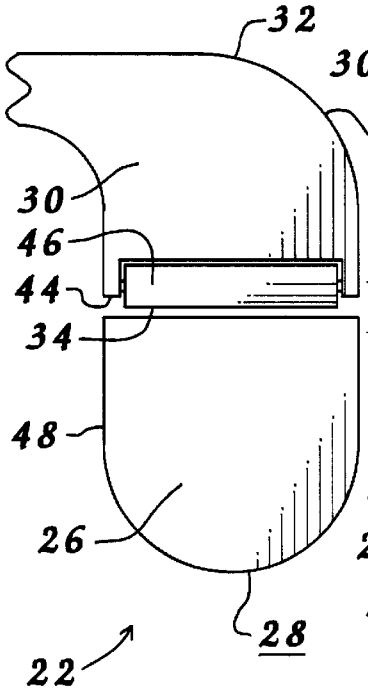
FIG. 3 is an enlarged rear elevational view of the thumb transfer device depicted in FIG. 2*a*.
Figure 5:
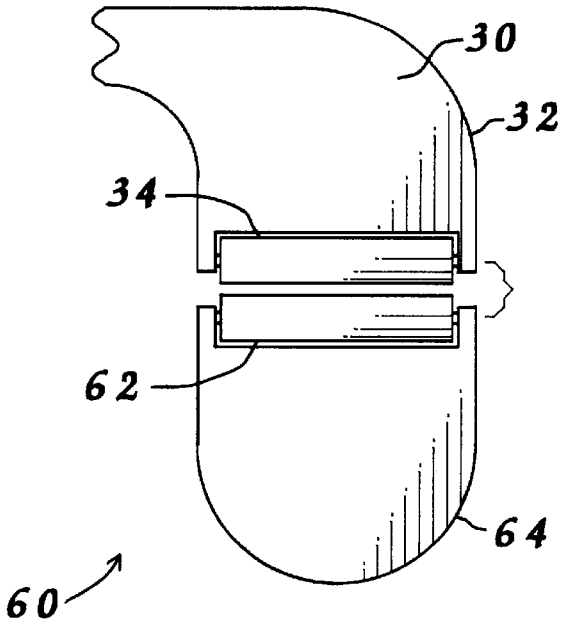
FIG. 5 is a rear elevational view of another embodiment of a thumb transfer device.
Figure 6:
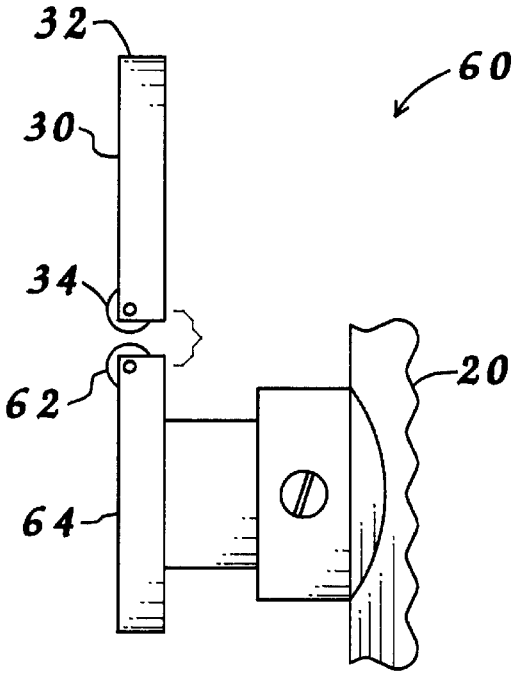
FIG. 6 is a side elevational view of the thumb transfer device depicted in FIG. 5.

The elevational height of thumb contact surface 30 of thumb key 32 changes during transfer between static position 38 and active position 40, see FIG. 2*b* and FIG. 2*c*. Therefore, it may be desirable to provide a thumb transfer device 60 having a secondary roller 62 on a thumb rest 64, see FIG. 5 and FIG. 6, to compliment roller 34 positioned on thumb key 32. This arrangement provides for ready movement of the thumb, not shown in any views except FIG. 2*a* through FIG. 2*c*, without regard for the elevational height of thumb key 32 during usage thereof.

Figure 7:
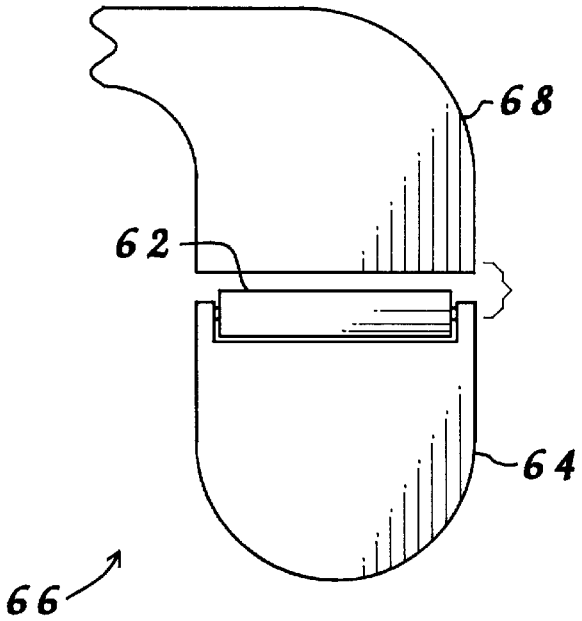
FIG. 7 is a rear elevational view of yet another embodiment of a thumb transfer device.
Figure 8:
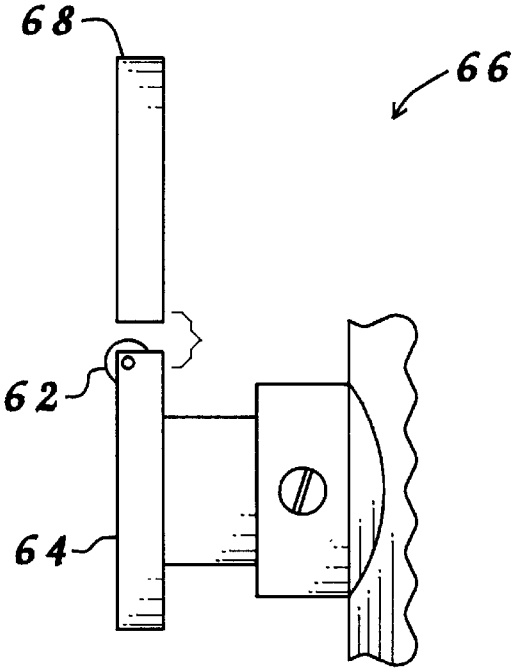
FIG. 8 is a side elevational view of the thumb transfer device depicted in FIG. 7.

When retrofitting an existing woodwind musical instrument it may not be convenient to install a roller on the existing thumb key. A particularly expedient method of providing the desired ready movement of the thumb resides in replacing the existing thumb rest with a thumb rest having the roller attached thereon. FIG. 7 and FIG. 8 depict a thumb transfer device 66 having thumb rest 64 installed adjacent a thumb key 68. Thumb rest 64 has height adjustment means as described elsewhere herein.

In certain installations it may be desirable to provide for installation of a roller without fixed attachment to either the thumb rest or the thumb key. In these situations a separate assembly may be attached to the woodwind between the thumb rest and the thumb key, (during installation it may be necessary to remove material from either the thumb rest, the thumb key or both in order to provide spacing for such installation).

Figure 9:
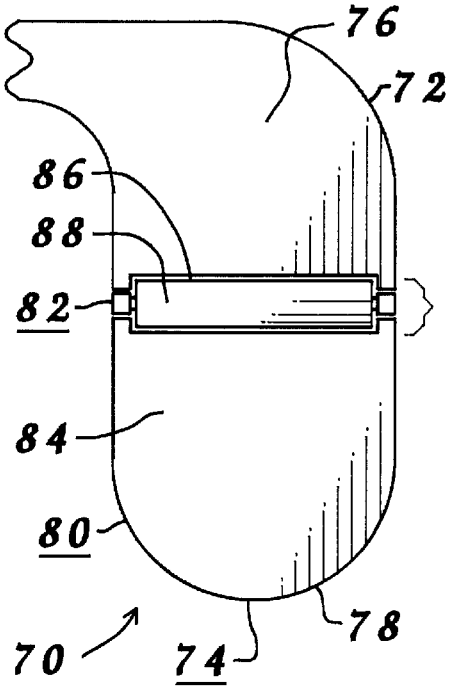
FIG. 9 is a rear elevational view of still another embodiment of a thumb transfer device.
Figure 10A:
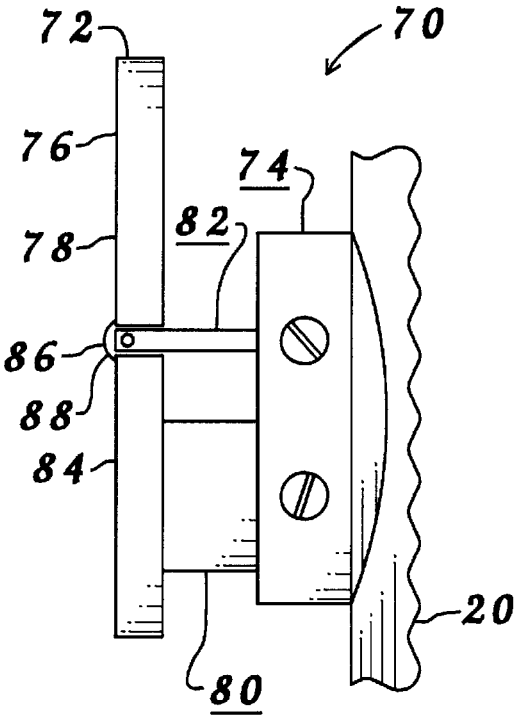
FIG. 10*a* is a side elevational view of the thumb transfer device depicted in FIG. 9.
Figure 10B:
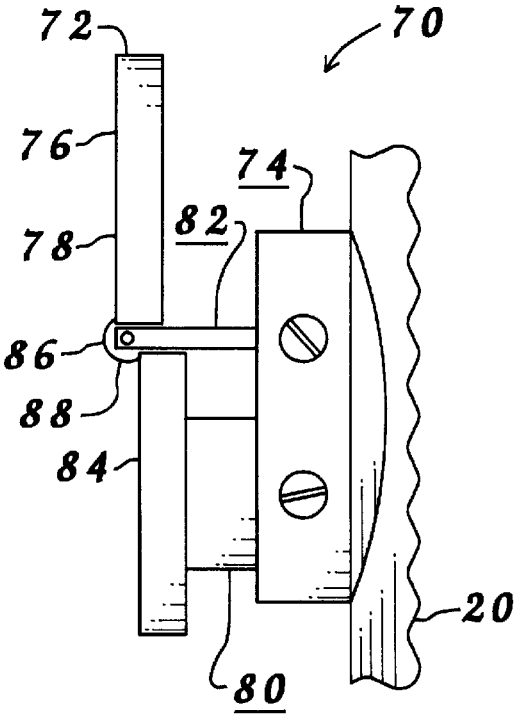
FIG. 10*b* and FIG. 10*c* are side elevational views of the thumb transfer device depicted in FIG. 10*a* in alternative elevational adjustments of the thumb rest and a roller.
Figure 10C:
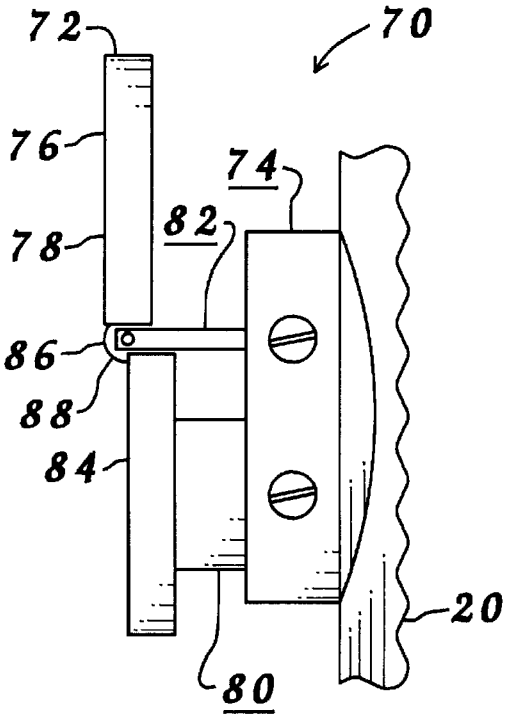

In certain situations it may be desirable to provide for elevational height adjustment of all three contact surfaces, (on the thumb rest, on the roller and on the thumb key). This is easily accomplished by providing for height adjustment means to any two (2) of the three contact surfaces. FIG. 9 through FIG. 10*c* depict a thumb transfer device 70 comprising a modified thumb key 72 and a mounting assembly 74. Modified thumb key 72 has a thumb contact surface 76 which remains in a static position 78 throughout the various views. (Modified thumb key 72 has an active position not shown in these views.) Mounting assembly 74 comprises a thumb rest assembly 80 and a roller assembly 82. A thumb contact surface 84 of thumb rest assembly 80 is elevationally adjustable relative to woodwind 20, as depicted between FIG. 10*a* and FIG. 10*b*, and therefore to thumb contact surface 76 of modified thumb key 72 while in static position 78. An outermost roller surface 86 of a roller 88 of roller assembly 82 is elevationally adjustable relative to woodwind 20, as depicted between FIG. 10*a* and FIG. 10*c*, and therefore to thumb contact surface 76 while in static position 78.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed:

1. A thumb transfer device to provide for a ready movement of a thumb between opposing positional placement locations on a woodwind musical instrument, the thumb transfer device comprising:

a) a thumb position combination comprising:

1) a thumb rest located on the woodwind musical instrument, the thumb rest having a thumb contact surface to provide for a positioning of the thumb;

2) a thumb key located adjacent the thumb rest on the woodwind musical instrument, the thumb key having a thumb contact surface to provide for a pressure bearing contact by the thumb, the pressure bearing contact to provide for a transfer of the thumb key between a static position and an active position wherein the active position provides for displacement of a closing element relative to an opening within a body of the woodwind musical instrument to produce a desired sound effect by the woodwind musical instrument;

b) a roller to provide for a rolling contact by the thumb during at least a portion of a transfer of the thumb between the thumb contact surface of the thumb rest and the thumb contact surface of the thumb key;

whereby the thumb may be moved between the thumb contact surface of the thumb rest and the thumb contact surface of the thumb key utilizing the rolling contact with the roller during at least the portion of the transfer.

2. The thumb transfer device defined in claim 1 further comprising height adjustment means to provide for varying an elevational height of the thumb contact surface of the thumb rest relative to the thumb contact surface of the thumb key while the thumb key is in the static position.

3. The thumb transfer device defined in claim 1 wherein the roller is positioned on the thumb key.

4. The thumb transfer device defined in claim 1 wherein the roller is positioned on the thumb rest.

5. The thumb transfer device defined in claim 1 further comprising a roller support assembly supporting the roller, the roller support assembly attached to the woodwind musical instrument between the thumb rest and the thumb key wherein the roller separates the thumb contact surface of the thumb rest and the thumb contact surface of the thumb key while the thumb key is in the static position.

6. The thumb transfer device defined in claim 1 wherein the roller is positioned on the thumb key wherein the roller separates the thumb contact surface of the thumb key from the thumb contact surface of the thumb rest while the thumb key is in the static position.

7. The thumb transfer device defined in claim 1 wherein the thumb is a left thumb and the thumb key is an octave key.

8. A thumb transfer device to provide for a ready movement of a thumb between opposing positional placement locations on a saxophone, the thumb transfer device comprising:

a) a thumb position combination comprising:

1) a thumb rest located on the saxophone, the thumb rest having a thumb contact surface to provide for a positioning of the thumb;

2) a thumb key located adjacent the thumb rest on the saxophone, the thumb key having a thumb contact surface to provide for a pressure bearing contact by the thumb, the pressure bearing contact to provide for a transfer of the thumb key between a static position and an active position wherein the active position provides for a displacement of a closing element relative to an opening within a body of the saxophone to produce a desired sound effect by the saxophone;

b) a roller attached to the saxophone to provide for a rolling contact by the thumb during at least a portion of a transfer of the thumb between the thumb contact surface of the thumb rest and the thumb contact surface of the thumb key;

whereby the thumb may be moved between the thumb contact surface of the thumb rest and the thumb contact surface of the thumb key utilizing the rolling contact with the roller during at least the portion of the transfer.

9. The thumb transfer device defined in claim 8 further comprising height adjustment means to provide for varying an elevational height of the thumb contact surface of the thumb rest relative to the thumb contact surface of the thumb key while the thumb key is in the static position.

10. The thumb transfer device defined in claim 8 wherein the roller is positioned on the thumb rest.

11. The thumb transfer device defined in claim 8 further comprising a roller support assembly supporting the roller, the roller support assembly attached to the woodwind musical instrument between the thumb rest and the thumb key wherein the roller separates the thumb contact surface of the thumb rest and the thumb contact surface of the thumb key while the thumb key is in the static position.

12. The thumb transfer device defined in claim 8 wherein the roller is positioned on the thumb key wherein the roller separates the thumb contact surface of the thumb key from the thumb contact surface of the thumb rest while the thumb key is in the static position.

13. The thumb transfer device defined in claim 8 wherein the thumb is a left thumb and the thumb key is an octave key.

14. A thumb transfer device to provide for a ready movement of a thumb between opposing positional placement locations on a saxophone, the thumb transfer device comprising:

a) a thumb rest located on the saxophone, the thumb rest having a thumb contact surface to provide for a positioning of the thumb;

b) a thumb key located adjacent the thumb rest on the saxophone, the thumb key having a thumb contact surface to provide for a pressure bearing contact by the thumb, the pressure bearing contact to provide for a transfer of the thumb key between a static position and an active position wherein the active position provides for a displacement of a closing element relative to an opening within a body of the saxophone to produce a desired sound effect by the saxophone;

c) a roller located on the thumb key to provide for a rolling contact with the thumb during at least a portion of a transfer of the thumb between the thumb contact surface of the thumb rest and the thumb contact surface of the thumb key;

whereby the thumb may be moved between the thumb contact surface of the thumb rest and the thumb contact surface of the thumb key utilizing the rolling contact with the roller located on the thumb key during at least the portion of the transfer.

15. The thumb transfer device defined in claim 14 further comprising height adjustment means to provide for varying an elevational height of the thumb contact surface of the thumb rest relative to the thumb contact surface of the thumb key while the thumb key is in the static position.

16. The thumb transfer device defined in claim 14 further comprising a second roller positioned on the thumb rest.

17. The thumb transfer device defined in claim 14 further comprising a roller support assembly supporting the roller, the roller support assembly attached to the woodwind musical instrument between the thumb rest and the thumb key wherein the roller separates the thumb contact surface of the thumb rest and the thumb contact surface of the thumb key while the thumb key is in the static position.

18. The thumb transfer device defined in claim 14 wherein the roller is positioned on the thumb key wherein the roller separates the thumb contact surface of the thumb key from the thumb contact surface of the thumb rest while the thumb key is in the static position.

19. The thumb transfer device defined in claim 14 wherein the thumb is a left thumb and the thumb key is an octave key.

* * * * *